United States Patent [19]

Calderon

[11] 3,984,926

[45] Oct. 12, 1976

[54] HEEL CUSHION

[76] Inventor: Samuel Calderon, 1501 Shanabrook, Akron, Ohio 44313

[22] Filed: Nov. 25, 1975

[21] Appl. No.: 635,138

[52] U.S. Cl. ..... 36/37; 36/71

[51] Int. Cl.[2] ..... A43B 21/32

[58] Field of Search ..... 36/71, 37; 128/581, 128/614

[56] References Cited

UNITED STATES PATENTS

| | | | |
|---|---|---|---|
| 792,688 | 6/1905 | Bliss | 36/37 |
| 1,113,266 | 10/1914 | Wachter | 36/37 |
| 1,195,327 | 8/1916 | Arrowsmith | 36/37 |
| 1,778,683 | 10/1930 | Messler | 36/37 X |
| 1,821,834 | 9/1931 | Hetter | 36/37 |
| 3,244,176 | 4/1966 | Neu | 128/581 |
| 3,859,740 | 1/1975 | Kemp | 36/71 |
| D25,242 | 3/1896 | Hills | 36/37 X |

FOREIGN PATENTS OR APPLICATIONS

| | | | |
|---|---|---|---|
| 241,717 | 10/1925 | United Kingdom | 36/37 |

*Primary Examiner*—Alfred R. Guest

[57] ABSTRACT

A heel cushion having a resilient and compressible pad formed by a pair of surfaces which diverge to a thickness from ¾ inches to 1¾ inches, inclusive. The resilient and compressible pad is formed of flexible and compressible material having a density in the range of 2.50 to 4.50 pounds per cubic foot, inclusive, and a compression in the range of 25 to 80 RMA, inclusive.

12 Claims, 9 Drawing Figures

HEEL CUSHION

BACKGROUND OF THE INVENTION

This application relates to a heel cushion for insertion into the heel portion of a shoe, boot, or any other piece of footwear. More particularly the present invention relates to a heel cushion which is insertable in a piece of footwear for helping to relieve the discomfort of painful heel spurs or growths or other sensitive heel ailments.

Applicant is one of the many sufferers of painful heel spurs. Surgical removal of such heel spurs is often not recommended, or only recommended as a very last resort if the heel spur becomes too painful to ambulate with. In addition, there are many persons who are simply very reluctant to have such heel spurs surgically treated. Thus, there are many people who are, by choice or by necessity, forced to live with such painful heel spurs or growths. In applicant's experience, such persons are generally in constant search for heel cushions which are capable of helping to relieve their discomfort.

Until the present invention applicant had been one of such persons. Applicant found that he was constantly trying commercially available foot pads, heel pads, or any other type of available cushion which he hoped would help to relieve his discomfort. In applicant's case, the need for an effective cushion was magnified because applicant is also very athletically inclined, and was therefore in need of a cushion which could help to relieve the discomfort of a heel spur or growth during strenuous athletic activity.

With the thought of trying to relieve his discomfort, applicant personally tried numerous commercially available foot cushions and heel cushions. Applicant found that the various forms of cushions which he was able to obtain and test were not satisfactory for relieving his own discomfort. Applicant tried wedge-shaped heel cushions having pads which were apparently formed of a very densely packed material and which, while being generally wedge-shaped, were only of a maximum thickness of under ½ inch. Other types of cushions tried were those designed to fit the inner contour of an entire shoe, with the usual result being that applicant's discomfort was not reduced to an appreciable extent.

Faced with such problems applicant set out to design his own heel cushion for helping to relieve the painful discomfort of heel spurs or growths. One particular feature which applicant found undesirable in commercially available cushions was that all tended to be relatively thin (with maximum thicknesses generally under ½ inch) and that all were formed of a fairly dense material.

SUMMARY OF THE PRESENT INVENTION

According to the present invention, applicant has designed a heel cushion which is believed to be far more helpful in relieving the discomfort of heel spurs such as applicant's than are any existing heel cushions known to applicant.

According to the present invention, a heel cushion includes a pad member formed of a resilient and compressible material. Moreover, according to the present invention there is provided a particularly compatible combination of pad member material characteristics and pad member shape which combine to form what the applicant has found to be a very effective heel cushion.

According to applicant's invention, the heel cushion includes a pad member having a pair of surfaces which diverge to a thickness of from ¾ inches to 1¾ inches, inclusive. Further, according to the present invention the pad member is formed of a resilient and compressible material having a density of 2.50 to 4.50 pounds per cubic foot, inclusive, and a compression ratio of 25 to 80 pounds RMA, inclusive. According to one preferred embodiment, the pad member is formed of latex foam rubber (natural, synthetic, or a combination of the two) having a density range of 2.50 to 4.50 pounds per cubic foot inclusive, and a compression ratio of 25 to 80 pounds RMA, inclusive. According to another preferred embodiment the pad member is formed of polyurethane having a density in a range of 2.50 to 4.00 pounds per cubic foot, inclusive, and a compression range between 25 pounds and 70 pounds RMA, inclusive.

The further objects and advantages of this invention will become further apparent from the following description taken with reference to the accompanying drawings in which.

Figure 1:
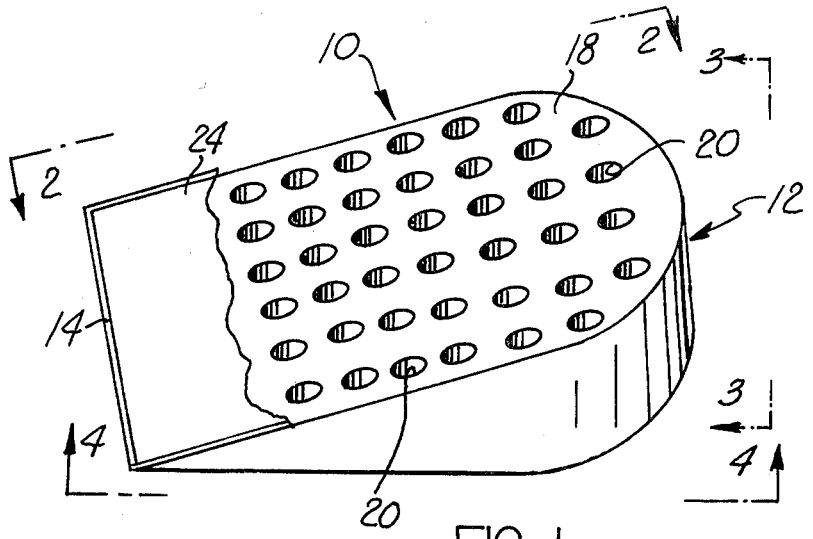
FIG. 1 is a perspective view of a heel cushion according to the present invention.
Figure 8:
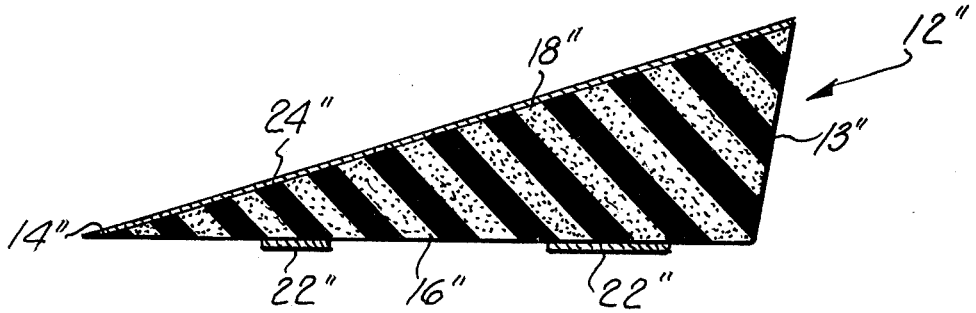
Figure 9:
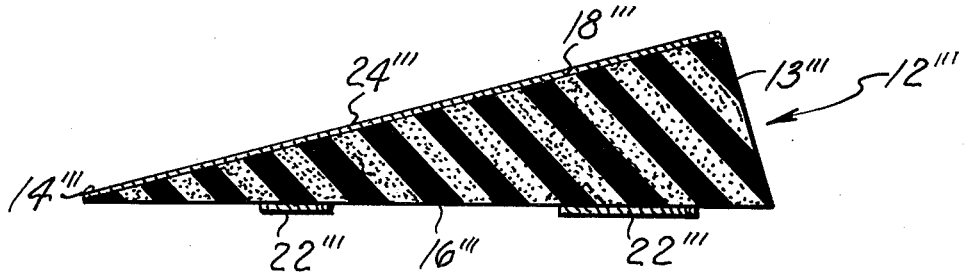

FIG. 8 is a sectional view of a heel cushion according to another modified form of the present invention, taken through a section of the heel cushion generally similar to that shown by lines 5—5 in FIG. 1; and FIG. 9 is a sectional view of a heel cushion according to a further modified form of the present invention, also taken through a section of the heel cushion generally similar to that shown by lines 5—5 in FIG. 1.

DETAILED DESCRIPTION OF THE PREFERRED EMBODIMENTS

As set forth above, the present invention relates to a heel cushion designed for insertion in a shoe, boot or any other piece of footwear. In FIGS. 1 through 6 the heel cushion comprises a pad member 10 and a cover 24. The pad member 10 is a resilient and compressible member having a lower surface 16 and an upper surface 18 which are joined along a front edge 14. The cover 24 preferably covers all of upper surface 18, but for illustration purposes a portion of the cover 24 of FIGS. 1 and 2 has been broken away.

The pad member 10 includes a rear portion 12 having a curved shape so as to conform to the walls surrounding the footwear heel. The overall length of the heel cushion is preferably such that when inserted in a piece of footwear the front edge 14 lies generally between the front of the foot heel and the midpoint of the arch. It should be noted that for the purposes of this description all references to a heel cushion contemplate a heel cushion in which the length of the lower surface 16 and the curvature of rear portion 12 can be designed to fit the specific contour of the interior of the wearer's shoe.

Referring further to FIGS. 1 through 6, the lower surface 16 of the pad member is designed to rest upon the inner heel portion of the footwear. For the purposes of this application the term "substantially flat" is intended to refer to a surface which is designed to be a flat surface, but which, particularly where any form of cutting of the surface is involved, may have a few imperfections which make it not quite 100% flat. The upper surface 18 of the pad member 10 is also designed as a substantially flat surface tapering upwardly from the front edge 14. As can be seen from FIGS. 1, 4 and 5, the preferred embodiment contemplates a pad member 10 which is a substantially wedge-shaped member. It is further contemplated, however, that either of the surfaces 16 or 18 could have a somewhat rounded front, in which case the surfaces might not converge to an edge such as 14.

The surfaces 16, 18 defining the pad member 10 diverge toward the rear portion 12 which is designed to fit the rear of a piece of footwear. The divergence of surfaces 16, 18 is such that the vertical rear surface 13 joining them has a thickness of between ¾ inches and 1¾ inches, inclusive. The preferred embodiment of this invention contemplates that the surfaces 16, 18 diverge to a thickness of 1⅜ inches. However, the weight of the user, and the degree of cushioning desired may be accomodated according to the present invention by a heel cushion having a pad member of material characteristics as specified herein, and whose upper and lower surfaces diverge to a thickness of from ¾ inch to 1¾ inches, inclusive. Applicant has found that a heel cushion having a pad member formed of the materials according to the present invention and which has a thickness of less than ¾ of an inch would not provide adequate cushioning to the heel of a person suffering a heel spur. On the other hand a pad member having a thickness of greater than 1¾ inches is not comfortable. Thus, the present invention contemplates a heel cushion having a pad member formed of a thickness of between ¾ inches and 1¾ inches. More specifically, the preferred embodiment of the present invention contemplates that the surfaces diverge to a thickness of 1⅜th inches. The applicant has found that a pad member of such a thickness is particularly comfortable in cushioning against painful heels.

According to one of the preferred embodiments of this invention, the pad member 10 is formed of latex foam rubber having a density of between 2.50 and 4.50 pounds per cubic foot, inclusive, and a compression ratio of between 25 pounds and 80 pounds RMA (Rubber Manufacturer Association), inclusive. The latex foam rubber may be either natural or synthetic, or a blend of natural and synthetic. According to this preferred embodiment, the latex foam rubber is shaped into the above-described pad member shape by a molding operation in approximately dimensioned molds. However, it is also contemplated that sheets of latex of sufficient starting thickness can be cut into the desired shape to form the pad. When the latter technique is used, applicant has found that a material formerly made by Sponge Products, Sheldon, Conn., and sold under the mark "Venti-Foam" and being of the "firm" or "extra firm" pincore type has the desired properties. Latex foam rubber sold in sheet form by Uniroyal and identifiable as "GP" (or General Purposes) has also been determined to have suitable properties for being cut into a heel cushion pad member according to the present invention.

Another preferred embodiment of the present invention contemplates that the pad member is formed of polyurethane having a density of 2.50 to 4.00 pounds per cubic foot, inclusive, and a compression ratio of 25 pounds to 70 pounds RMA, inclusive. This preferred embodiment of the invention also contemplates that the polyurethane is molded into the shape of the heel cushion pad. Moreover, it is also contemplated that sheets of polyurethane of sufficient starting thickness can be cut into the desired shape to form the pad. In using the latter technique, applicant has found that material made by Firestone Tire and Rubber, East Providence, R.I., and identifiable as "No. 2845 Non-Loaded Firestone 10 yr Pro Rated Guarantee Urethane" is suitable.

Figure 7:
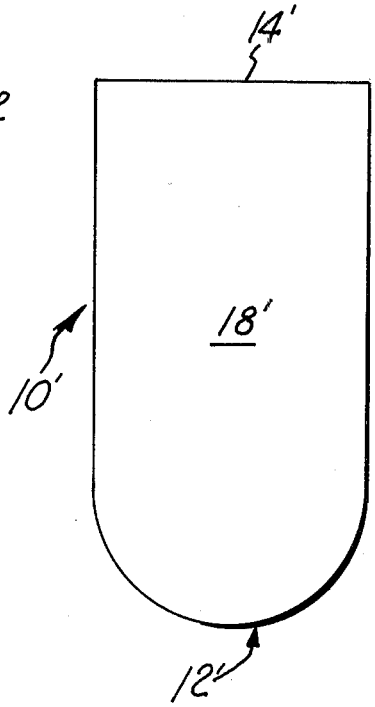
FIG. 7 is a top view of a pad member forming a modified form of heel cushion according to the present invention.

Referring back to FIG. 1 it should be further noted that the preferred embodiment of this invention further contemplates a plurality of holes 20 formed in pad member 10. The holes may extend completely or partially through the pad member 10. It is believed that when employed with the materials according to the present invention (particularly latex foam rubber) these holes help to make the heel cushion particularly comfortable. In addition, the modified embodiment shown in FIG. 7 contemplates a pad member 10 without such holes.

In a further aspect of the invention, means may be provided for securing the pad surface 16 to a surface of a piece of footwear. In FIGS. 3–6 several pieces of tape 22 having adhesive on both sides, are disposed with one side adhesively secured to the surface 16.

Figure 2:
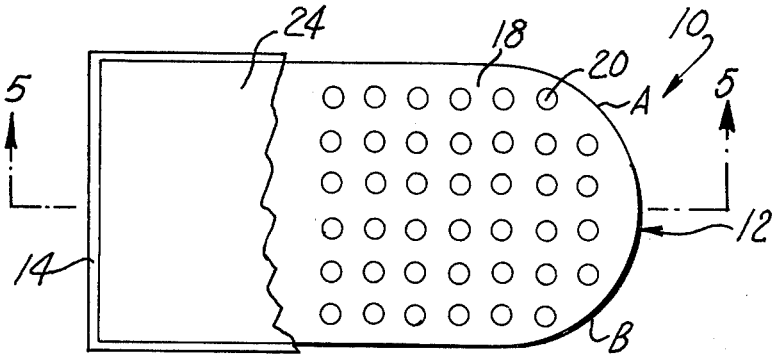
FIG. 2 is a top view of the heel cushion of FIG. 1, taken from the direction 2—2 in FIG. 1.
Figure 4:
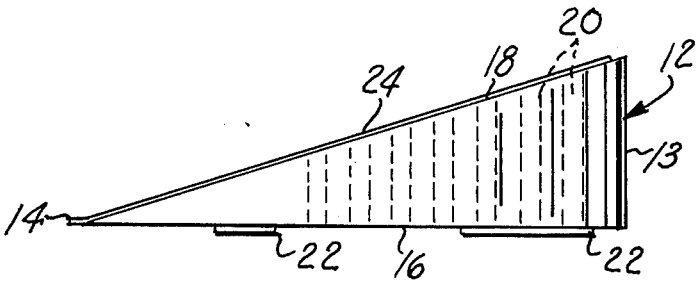
FIG. 4 is a side view of the heel cushion of FIG. 1, taken from the direction 4—4 in FIG. 1.
Figure 3:
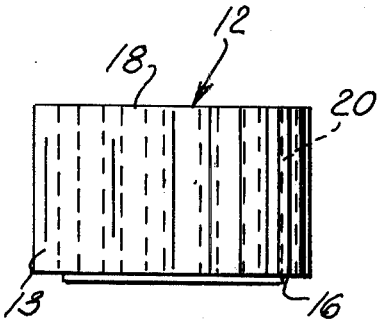
FIG. 3 is a rear view of the heel cushion of FIG. 1, taken from the direction 3—3 in FIG. 1.
Figure 6:
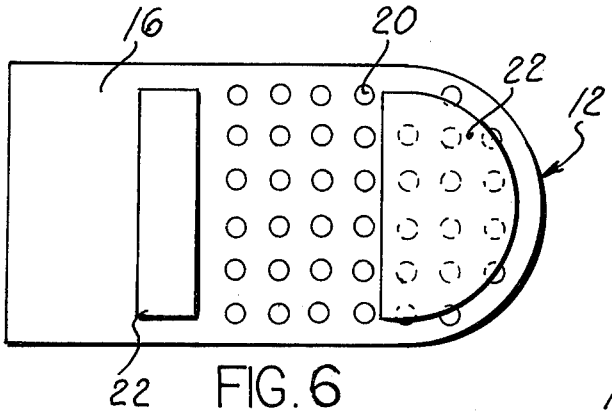
FIG. 6 is a bottom view of the heel cushion of FIG. 1.
Figure 5:
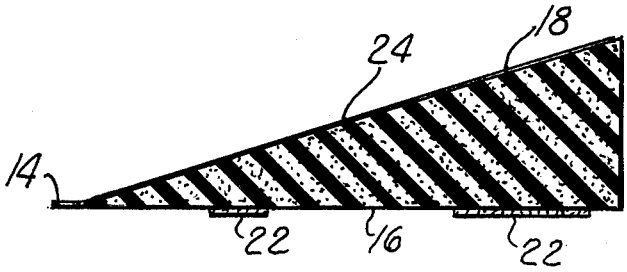
FIG. 5 is a sectional view of the heel cushion of FIGS. 1–4, taken from the direction shown by 5—5 in FIG. 2.

Also, as seen in FIG. 1, the surface 18 has a cover 24 secured thereto. The cover 24 preferably covers the entire surface 18. In FIGS. 1 and 2, a portion of the cover 24 is seen broken away to better illustrate the pad member. The cover can be of leather, vinyl or any similar material. The cover is preferably of a color which is compatible with the color of the footwear with which the heel cushion is designed to be used.

FIGS. 8 and 9 show further modified forms of a pad member according to the invention. In each of these modified forms the pad member includes a pair of diverging surfaces similar to the diverging surfaces of the embodiment of FIGS. 1–6, and the modification resides principally in the contour of the rear portion. In all of the embodiments the reference to the "rear portion" is intended to refer to the surface of the pad member which joins the upper and lower surfaces and which extends approximately from point A to point B in FIG. 2.

In FIG. 8, a pad member is formed of a pair of diverging surfaces in a manner generally similar to the pad member of FIGS. 1–6, but the rear portion of the surface 13'' joining the diverging surfaces 16'', 18'' tapers slightly forwardly (i.e., toward the front edge 14', or front portion). In the further embodiment of FIG. 9 the surface 13''' joining diverging surfaces 16''', 18''' tapers slightly rearwardly. In either case the thickness range and the preferred material would be as set forth heretofore.

Thus, according to the foregoing description, the present invention provides what applicant believed to be a particularly desirable heel cushion. With the foregoing disclosure in mind, many and varied obvious modification of the principles of this invention may become further apparent to those of ordinary skill in the art.

Therefore, what is claimed is:

1. A heel cushion comprising a pad member having a pair of surfaces which diverge to a thickness ¾ inches to 1¾ inches, inclusive, said pad member being formed of a resilient and compressible material having a density in the range of 2.50 to 4.50 pounds per cubic foot, inclusive, and a compression in the range of 25 to 80 RMA, inclusive.

2. A heel cushion as set forth by claim 1 wherein said resilient and compressible material comprises latex foam rubber.

3. A heel cushion as set forth by claim 2 wherein said pair of surfaces diverge to a thickness of 1⅜ inches.

4. A heel cushion as set forth by claim 1 wherein said material comprises polyurethane having a density in the range of 2.50 to 4.00 pounds per square foot, inclusive, and a compression in the range of 25 to 70 RMA, inclusive.

5. A heel cushion as set forth by claim 4 wherein said pair of surfaces diverge to a thickness of 1⅜ inches.

6. A heel cushion as set forth in claim 1 wherein said paid of surfaces comprise a substantially flat first surface and a substantially flat second surface angularly disposed with respect to said first surface, a plurality of parallel holes formed in said pad, said plurality of holes disposed perpendicular to said first surface.

7. A heel cushion as set forth by claim 6 wherein said resilient and compressible material comprises latex foam rubber.

8. A heel cushion as set forth by claim 1 wherein said pair of surfaces comprise a substantially flat first surface and a substantially flat second surface angularly disposed with respect to said first surface, further including means for securing said first surface to surface of a piece of footwear.

9. A heel cushion as set forth by claim 8 wherein said means for securing said first surface to a surface of a piece of footwear comprises one or more pieces of tape with adhesive means on both surfaces thereof, one surface of said tape being adhesively secured to said first surface.

10. A heel cushion as set forth by claim 9 and further including a strip of covering material secured to said second surface.

11. A heel cushion as set forth by claim 1 wherein said surfaces diverge from a front portion to a rear portion, said rear portion comprising a rear surface joining said diverging surfaces, said rear surface having a portion tapering forwardly from said lower surface.

12. A heel cushion as set forth by claim 1 wherein said surfaces diverge from a front portion to a rear portion, said rear portion comprising a rear surface joining said diverging surfaces, said rear surface having a portion tapering rearwardly from said lower surface.

* * * * *

UNITED STATES PATENT AND TRADEMARK OFFICE

CERTIFICATE OF CORRECTION

PATENT NO. : 3,984,926
DATED : October 12, 1976
INVENTOR(S) : Samuel Calderon

It is certified that error appears in the above-identified patent and that said Letters Patent are hereby corrected as shown below:

Column 5, line 24, change "paid" to --pair--.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*